United States Patent [19]

Fee et al.

[11] Patent Number: 4,753,387

[45] Date of Patent: Jun. 28, 1988

[54] BAG DEPOSITORY FOR DRIVE-UP BANKING AND THE LIKE

[75] Inventors: Kevin A. Fee, Marion; Daniel J. Banyas, Cedar Rapids, both of Iowa

[73] Assignee: LeFebure Corporation, Cedar Rapids, Iowa

[21] Appl. No.: 78,988

[22] Filed: Jul. 29, 1987

[51] Int. Cl.[4] ..... B65D 91/00

[52] U.S. Cl. ..... 232/43.3; 232/44

[58] Field of Search ..... 232/43.3, 43.2, 44, 232/43.1

[56] References Cited

U.S. PATENT DOCUMENTS

| | | | |
|---|---|---|---|
| 1,704,865 | 3/1929 | McClintock et al. . | |
| 1,759,129 | 5/1930 | McClintock et al. . | |
| 2,563,150 | 8/1951 | Behrens | 232/44 |
| 3,145,918 | 8/1964 | Higgins et al. | 232/44 X |
| 3,390,833 | 7/1968 | Harris | 232/44 X |
| 3,615,050 | 10/1971 | Deaton et al. | 232/43.3 |
| 3,707,261 | 12/1972 | Cutter | 232/44 |
| 4,063,520 | 12/1977 | Parsons | 232/44 X |

OTHER PUBLICATIONS

The LeFebure Touch brochure, The LeFebure 3000 Series ATM.

*Primary Examiner*—Robert W. Gibson, Jr.

*Attorney, Agent, or Firm*—Simmons, Perrine, Albright & Ellwood

[57] ABSTRACT

A bag depository for a drive-up type of automatic teller machine features a drum having a deposit receiving cavity. The drum rotates about its axis between deposit receiving and deposit dump positions. As the drum rotates from its dump to its receiving position the drum also moves forwardly from the rear to the front of its housing to receive a deposit and then retreats to the rear of the housing to dump the deposit. At an intermediate position in its forward movement the drum engages a drawer and pushes the latter forward to an open position at which point the drawer forms a forwardly extending shelf upon which the customer places his deposit and from which the deposit slides into the drum cavity. When the drum retreats it pulls the drawer closed and then alone continues on rearwardly to dump the deposit.

14 Claims, 9 Drawing Sheets

BAG DEPOSITORY FOR DRIVE-UP BANKING AND THE LIKE

BACKGROUND OF THE INVENTION

Automatic teller machines ("ATM's") are presently in wide use in different applications. Some are in or adjacent banks, some elsewhere, so that customers can perform various banking transactions at any hour, any day. A typical ATM in that role allows an authorized customer to receive cash, make deposits, transfer funds from one account to another, and so forth. Deposits are generally of two types; cash or checks or both are placed in an envelope and the latter taken into the ATM by an envelope depositing mechanism. Other, larger deposits of cash and checks are placed in a bag and the bag taken into the ATM through a bag depositing mechanism, the bag dropping into a secure chest within the machine. All this is done while the customer stands before the machine so that its functions are easily at hand.

In drive-up banking, however, the customer is seated in a car from which it is usually difficult and awkward to reach any significant distance to make a deposit. So the practice in that case is to bring the receptable into which the deposit is to be made to the seated customer so far as possible. In teller-assisted drive-up banking this is done in some instances by use of a "deal drawer", examples of which are found in U.S. Pat. Nos. 3,145,918 and 3,390,833, which moves horizontally from the teller station towards the customer and opens to provide a receptacle not only conveniently at hand but whose entire interior is clearly visible to the customer. The latter aspect is important to the customer's peace of mind who wants assurance that his or her deposit is being properly received. But the same thing is not so readily achieved when an ATM is used for drive-up banking. It is one thing for car-borne customers to reach the ATM with their cards, to manipulate its keyboard, and to receive cash or make an envelope deposit. But to make a bag deposit from a car is another thing entirely, both from the standpoint of customer satisfaction as well as from that of security of the ATM.

If a "hopper" type bag depository is used, such as shown in U.S. Pat. No. 4,063,520, in a drive-up ATM, the interior of the receptacle may not be readily visible to the customer unless the depository is mounted low-down on the front of the ATM in which case the capacity of the chest into which it empties is limited. The same is essentially true of the "drum" type, such as shown in U.S. Pat. No. 3,707,261. And neither moves from the ATM towards the customer as does a deal drawer. A "drawer" type depository, however, such as shown in U.S. Pat. No. 3,990,630, unlike the others advances towards the customer in the manner of a deal drawer but the interior of its receptacle, which opens through the top of the drawer, may not be readily visible to the customer unless it too is mounted well down on the ATM. The drawer type, however, has one advantage the other two do not: as it closes it can move the deposit not only from the customer but also well to the rear of the ATM. This aspect is important in a drive-up ATM, which is often a free standing unit, because then the chest itself can be located well to the rear of the ATM's front wall and thus increase its security.

So the chief object of the present invention is a bag depository which incorporates the features of prior bag depositories which are desirable for security and convenience reasons in a drive-up ATM but eliminates those which are not.

SUMMARY OF THE INVENTION

The bag depository of the invention is a combination in many respects of the drum and drawer types. The drum revolves about its axis in the usual manner between a deposit receiving position in which the deposit receiving cavity in the drum opens upwardly and a deposit discharge or dump position in which the cavity opens downwardly to drop the deposit into the chest below. At the same time, however, as the drum rotates from its deposit receiving to its deposit discharge position, the entire drum moves rearwardly from the front to adjacent the rear of the ATM, the chest consequently being disposed at the rear of the ATM below the drum and thus in a more secure location.

The "drawer", in turn, when "closed", shuts an opening in the front of the ATM, the drawer having a front wall for that purpose and in effect a pair of sidewalls which extend rearwardly a short distance from the front wall. When the depository is activated to receive a deposit the drum only moves forwardly from its discharge or rear position at the back of the ATM to an intermediate position at which point the drum engages the sidewalls of the drawer and pushes the drawer to its "open" position when the drum has reached its deposit receiving or forward position. The drum cavity in the latter position opens upwardly at an angle so that its entire interior is clearly visible to the customer seated in his or her car. The drawer includes an inclined shelf extending between its sidewalls, which shelf forms a forward, upwardly inclined extension of the lower wall of the drum cavity when the drum is in its forward position. The customer can then place the deposit on the shelf and watch it slide rearwardly and downwardly into the drum cavity itself. Thus the drawer in effect acts much like a deal drawer since it opens toward the customer and provides a forward opening into which the deposit is placed and from which it moves into the drum.

Movement of the drawer between its open and closed positions is controlled by the drum which in turn is impelled between its forward and rear positions and also rotated by an electric motor and an arrangement of racks and gears. When the drum moves forwardly to its intermediate position and engages the drawer, a latch couples the two together so that as the drum moves rearwardly after a deposit is made the drum pulls the drawer closed, the drawer reaching its closed position when the drum reaches its intermediate position, at which point a cam releases the latch and allows the drum by itself to continue on to its rear position. A separate latching mechanism prevents opening movement of the drawer independently of the drum both while the drum is at its rear position and while between the latter position and its intermediate position, the latching mechanism being electrically released while the drum moves from its intermediate position to its forward position to open the drawer.

Other features and advantages of the invention will become apparent from the drawings and the more detailed description which follows.

DETAILED DESCRIPTION OF THE PREFERRED EMBODIMENT a. Structure

Figure 7:
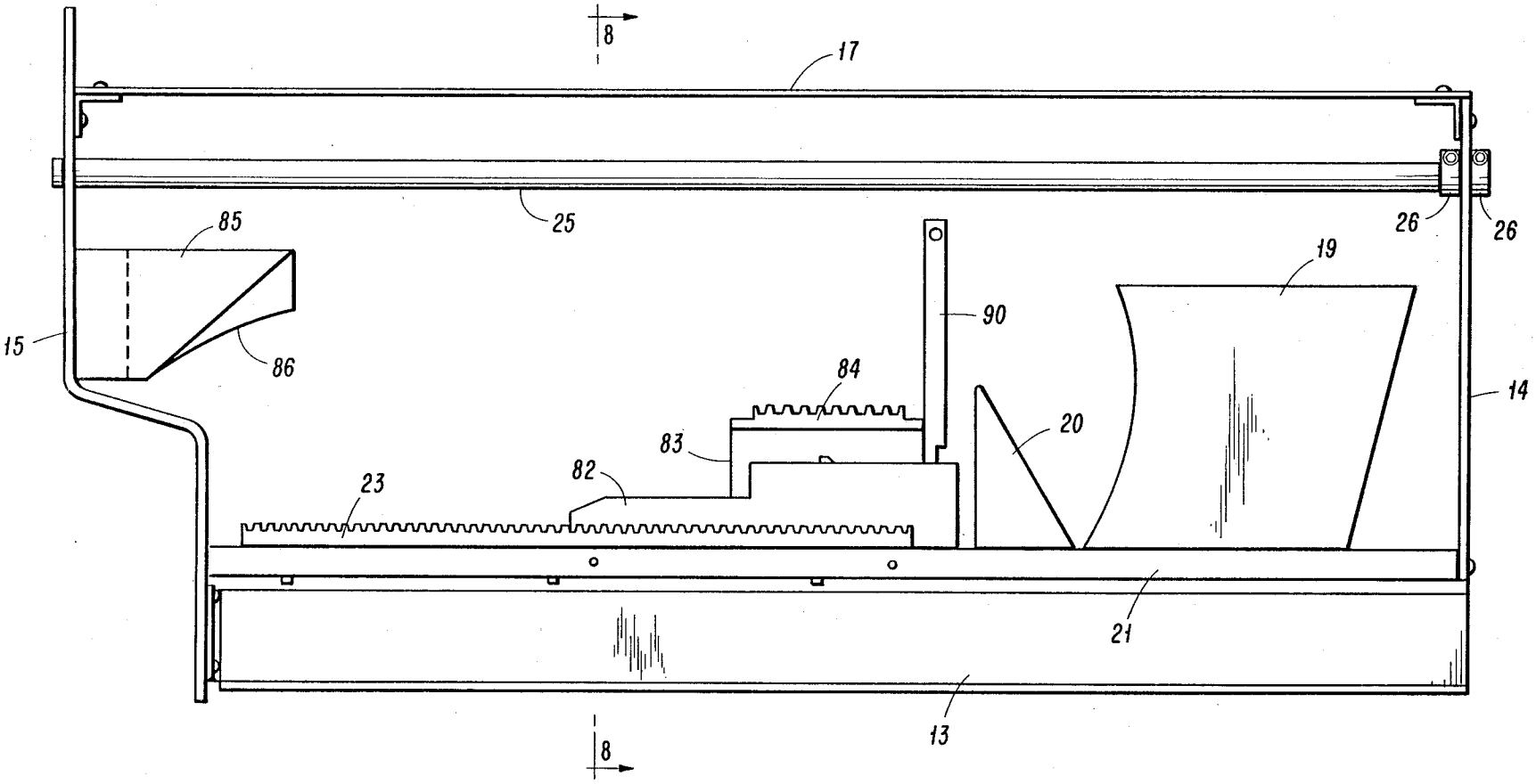
FIG. 7 is a side elevational view of the basic framework of the depository.
Figure 8:
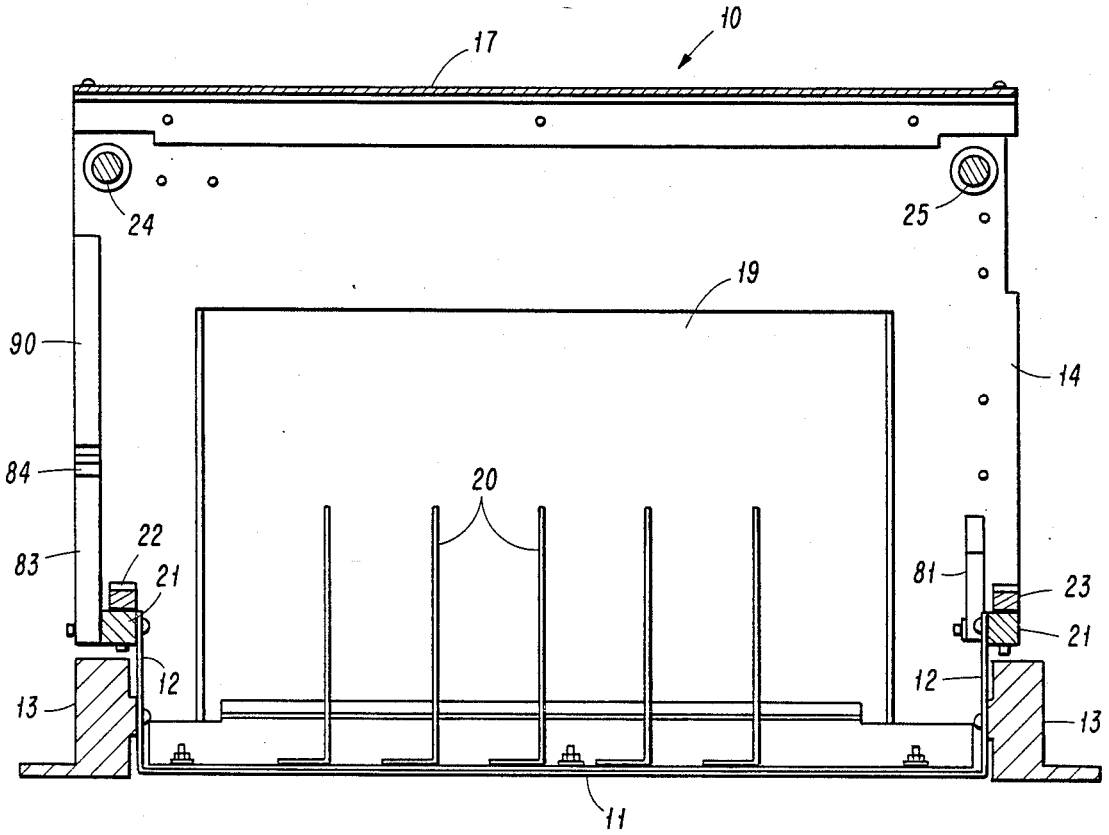
FIG. 8 is a sectional view taken along the line 8—8 of FIG. 7.

The bag depository of the invention is a separate subassembly which slides into the ATM housing (not shown) from the front. As shown in FIGS. 7 and 8, the depository is built on a chassis 10 comprising a floor pan 11 having upturned side flanges 12 to which are secured a pair of flanged rails 13. The rails 13 in turn are secured to a pair of typical telescoping drawer carriers (not shown) mounted in the ATM housing so that the depository can be slid forwardly from the ATM for servicing. To the ends of the rails 13 are fixed a rear end plate 14 and a contoured front end plate 15 apertured at 16, the end plates 14 and 15 being connected by a cover plate 17. Adjacent its rear the floor pan 11 is rectangularly apertured at 18 (see FIGS. 2 and 4) which is surrounded on its sides and rear by a chute 19 leading to the depository chest (not shown) below at the rear of the ATM. Along the forward edge of the aperture 18 a number of upright chute clearing plates 20 are secured to the floor pan 11. A pair of fore-and-aft square bars 21 are also secured to the flanges 12 and the end plates 14 and 15 to the tops of which in turn are fixed a pair of racks 22 and 23. A pair of guide rods 24 and 25 span the end plates 14 and 15 adjacent their upper corners, being retained by split collars 26 sandwiching the end plate 14.

Figure 9:
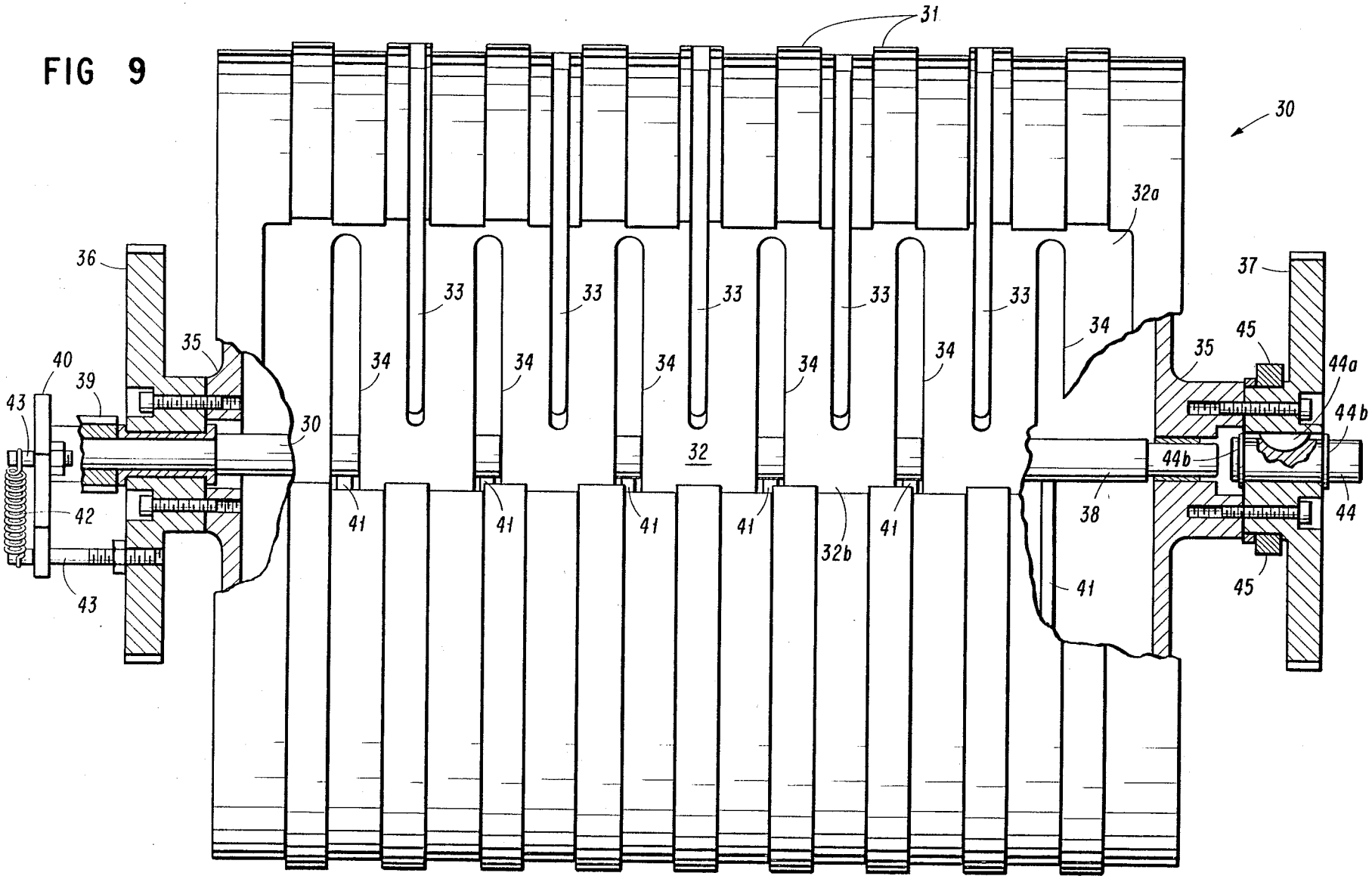
FIG. 9 is an elevational view of the periphery of the drum, certain portions being sectioned to illustrate structural details.
Figure 10:
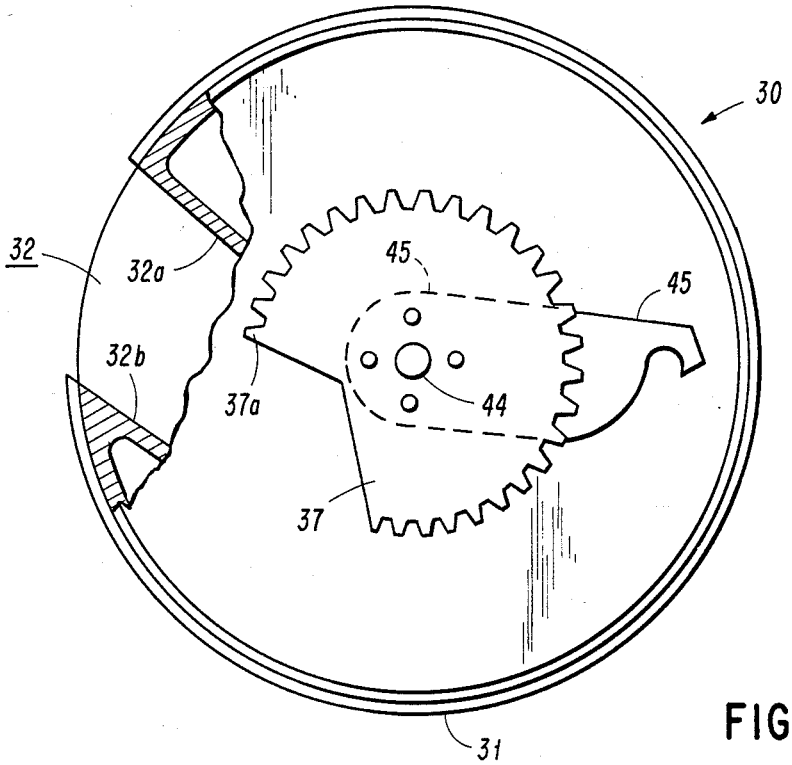
FIG. 10 is an elevational view of one end of the drum of FIG. 9, certain portions being sectioned to illustrate structural details.
Figure 11:
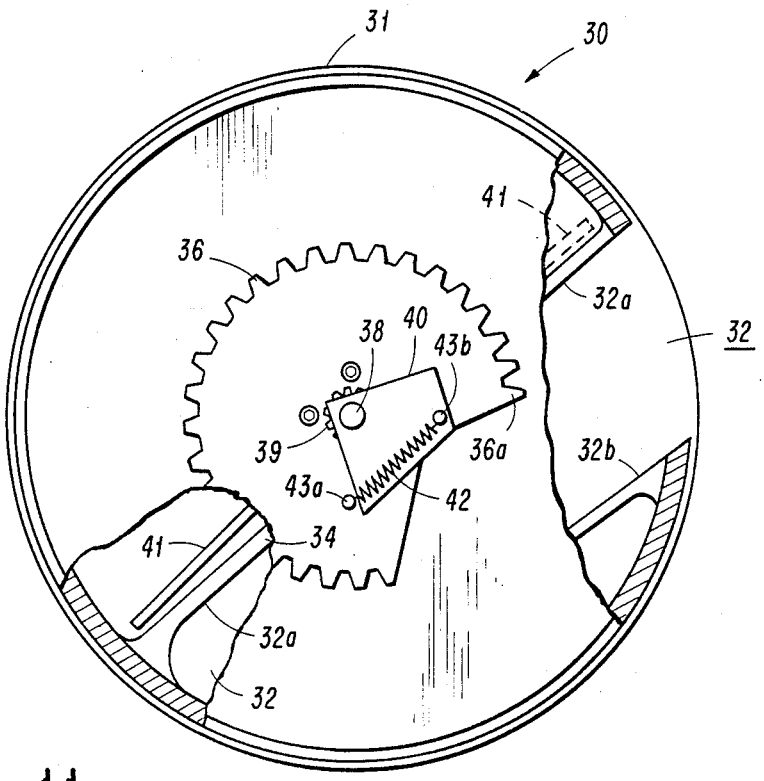
FIG. 11 is an elevational view of the other end of the drum of FIG. 10, certain portions being sectioned to illustrate structural details.

The drum 30, as shown in FIGS. 9, 10 and 11, is an alloy casting having circumferential ribs 31 and a generally rectangular deposit receiving cavity 32 opening through its periphery, its upper and lower longitudinal walls 32*a* and 32*b* diverging outwardly as shown in FIGS. 10 and 11. The cavity wall 32*a* and the adjacent periphery of the drum 30 are provided with radial slots 33 spaced so that the chute clearing plates 20 can pass therethrough as later described. Both cavity walls 32*a* and 32*b* are also provided with radial slots 34 disposed between the slots 33 but terminating short of the periphery of the drum 30. The outer ends of the drum 30 include integral hubs 35 to which in turn are fixed a pair of sector gears 36 and 37. The hubs 35 and gears 36 and 37 are axially bored, the gear 36 journaling one end of a shaft 38 whose other end is journaled in the opposite hub 35. To the former end of the shaft 38 is keyed a small spur gear 39 and a lever plate 40. A series of drum cavity clearing fingers 41 extend radially from the shaft 38 within the drum cavity slots 34 such that rotation of the shaft 38 relative to the drum 30 will cause the fingers 41 to sweep through the cavity 32 from the position shown in FIG. 11 counter-clockwise to a position substantially 180 degrees therefrom as shown in broken lines in FIG. 11, the fingers 41 being retained in the position shown in full lines in FIG. 11 by a spring 42 secured between the gear 36 and the lever plate 40 by pins 43*a* and 43*b*, respectively. A short stub shaft 44 is keyed at 44*a* in the opposite gear 37 and retained by snap rings 44*b*. A latch plate 45 of the configuration shown in FIG. 10 is also journaled on the hub of the gear 37 for purposes to be described.

Figure 4:
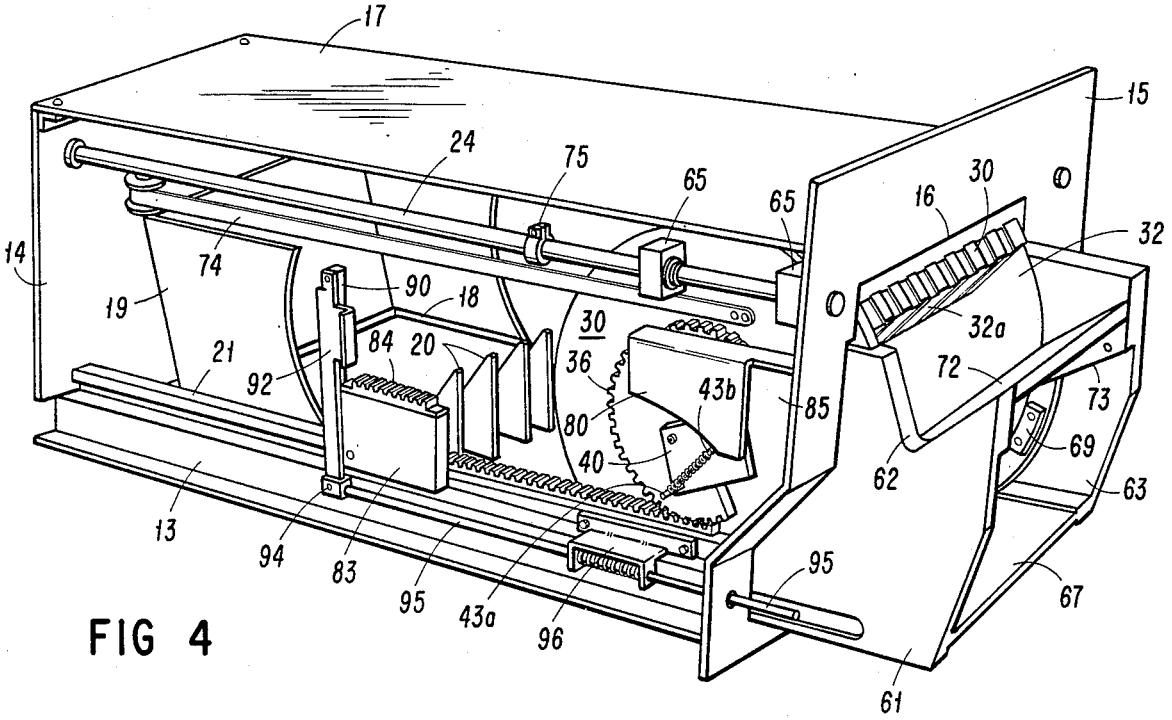
FIG. 4 is like FIG. 2 and shows the other side of the depository in its open position.
Figure 5:
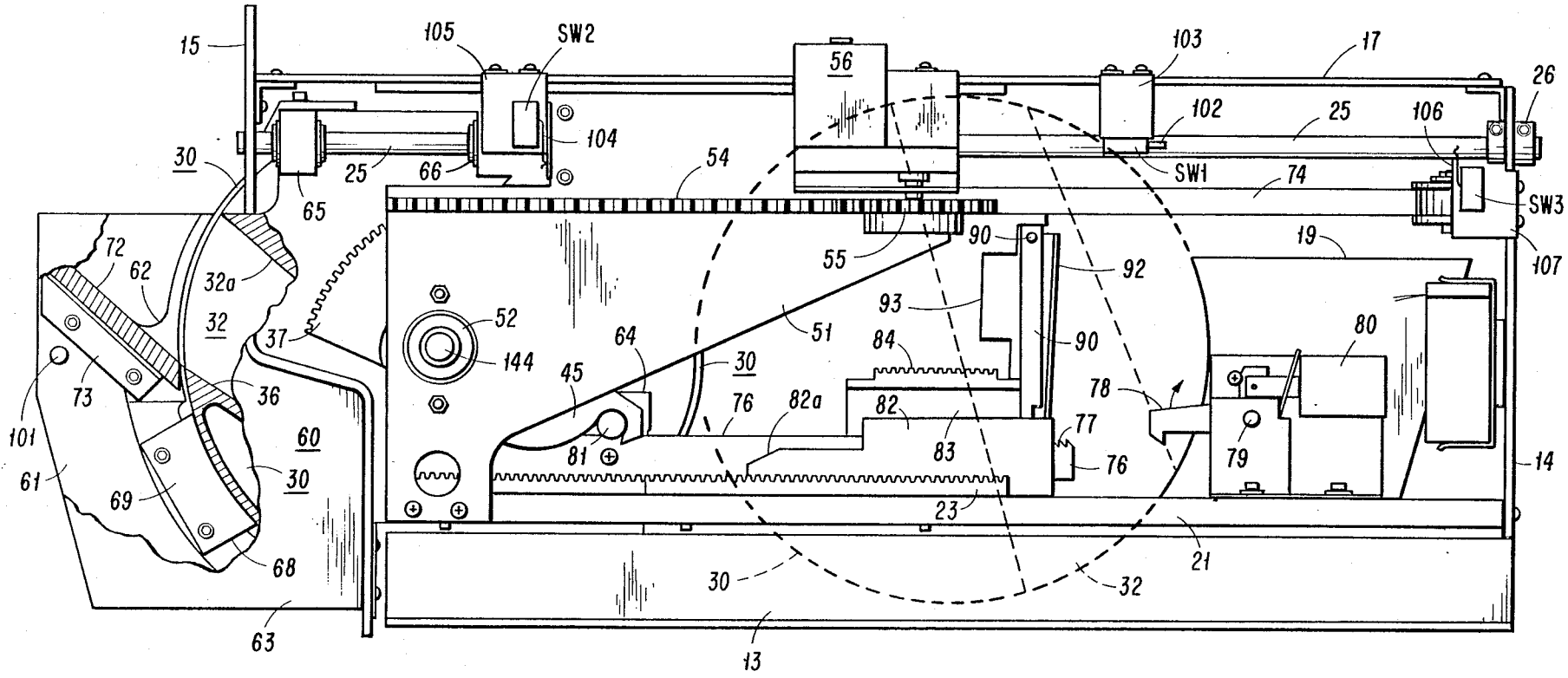
FIG. 5 is a side elevational view of the depository of FIG. 2 with certain portions broken away to illustrate the cooperation between the drum and the drawer.
Figure 6:
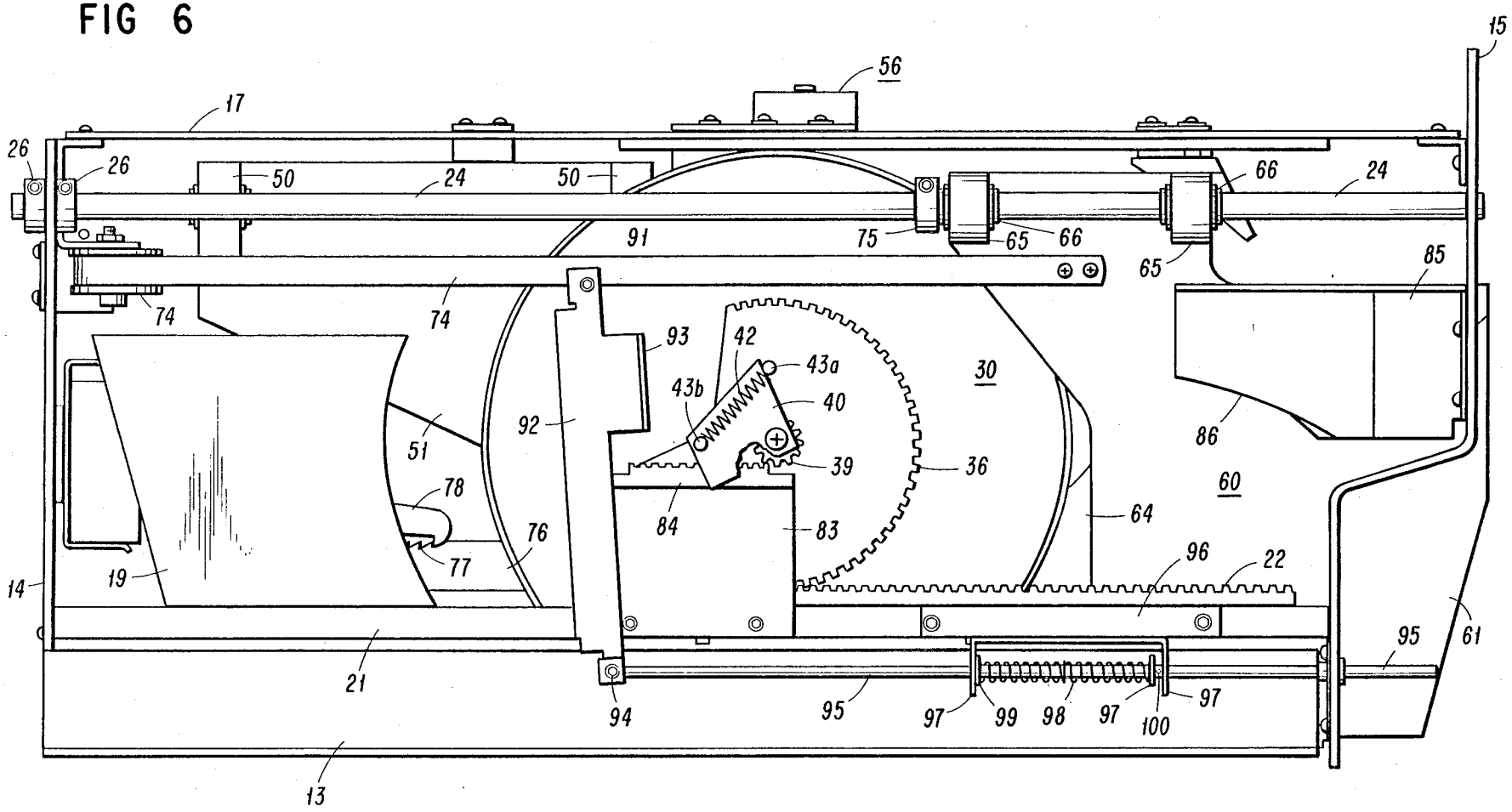
FIG. 6 is a side elevational view of the depository of FIG. 3 but showing the drum near the end of its rearward travel.

The drum 30 is mounted within the chassis 10, as shown in FIGS. 1-6, with the sector gears 36 and 37 engaging the racks 22 and 23, their teeth 36*a* and 37*a* being disposed adjacent the rear ends of the racks 22 and 23 when the drum is in its rear or deposit discharge or dump position, at which point the drum cavity 32 opens downwardly into the floor pan aperture 18 as indicated in broken lines in FIG. 5. In order to guide the drum 30 along the racks 22 and 23, the guide rod 25 receives a pair of linear bearings 50 from whose outer faces is suspended the upper end of a configured bracket plate 51 carrying a ball bearing assembly 52 in which the drum stub shaft 44 rotates, the lower end of the plate 51 being fitted with a guide block 53 which slides against the outer face of the adjacent square bar 21. The plate 51 is provided with a horizontal rack 54 which is engaged in turn by a large pinion gear 55 driven by a reversible electric motor and reduction gear box 56 suspended from the cover plate 17 by a bracket 57.

Figure 12:
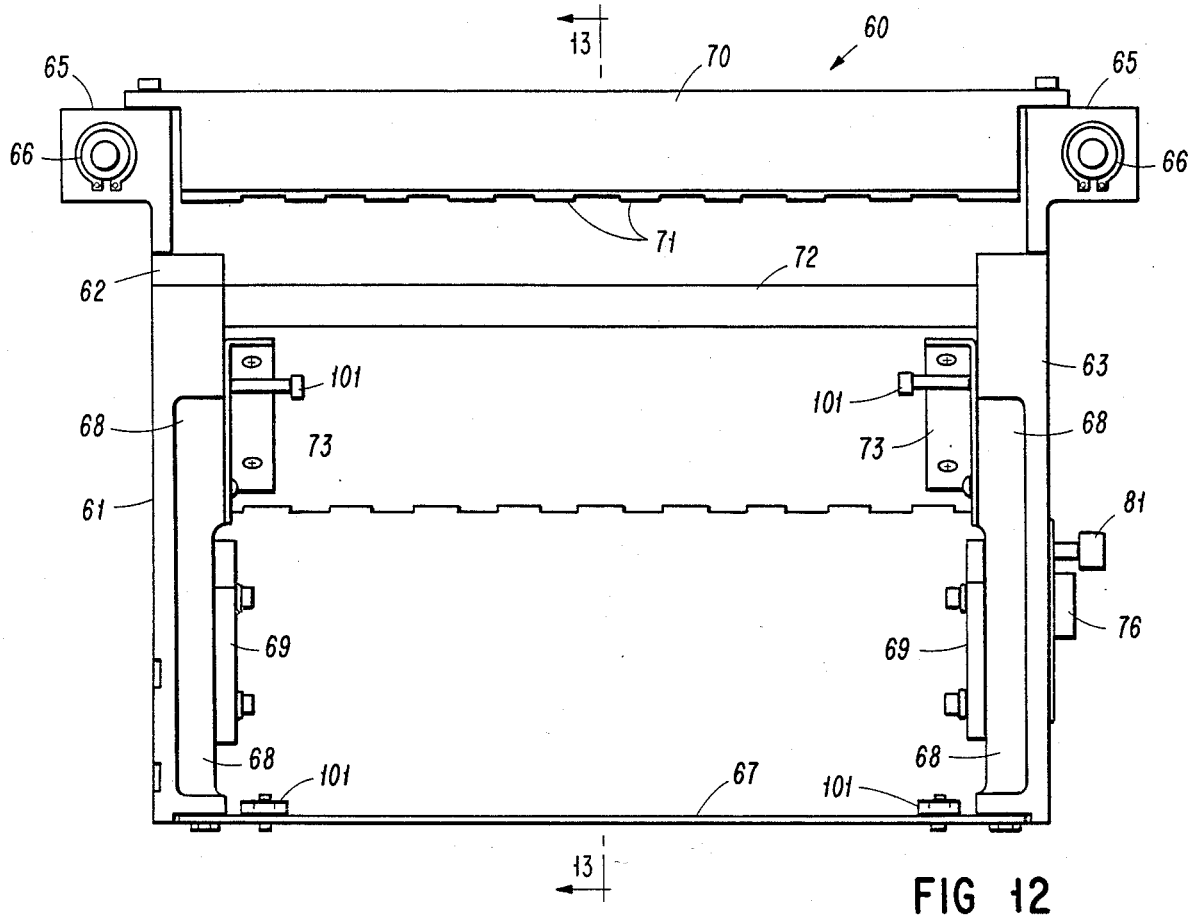
FIG. 12 is a front elevational view of the drawer.
Figure 13:
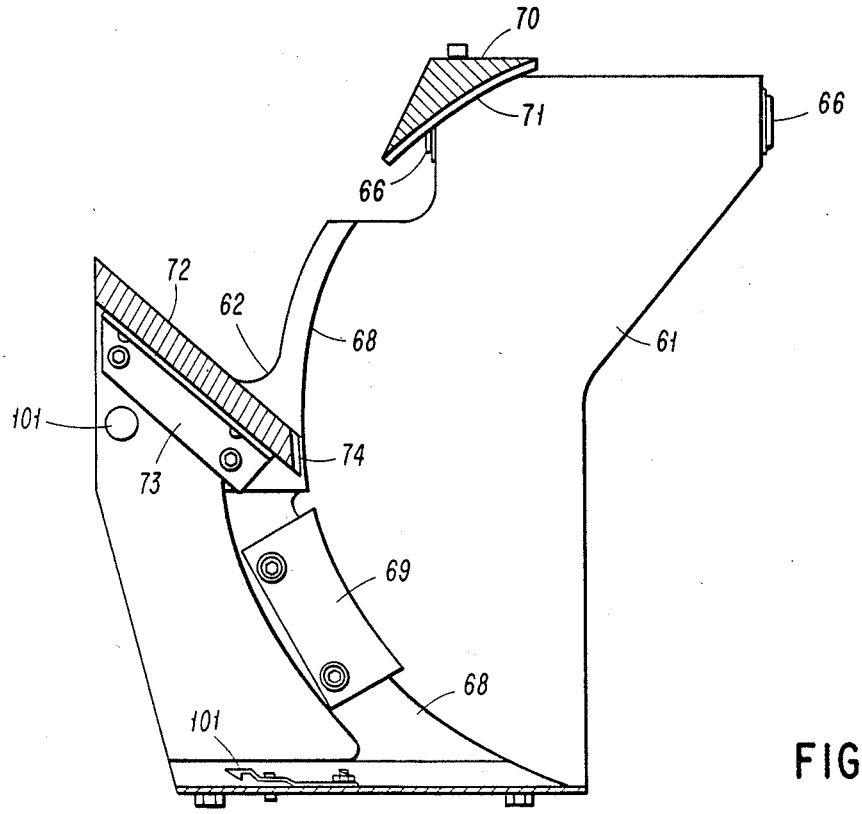
FIG. 13 is a sectional view taken along the line 13—13 of FIG. 12.

The drawer 60, which slides back and forth through the front end plate aperture 16, comprises a pair of cast alloy side walls, the lefthand one 61 (as viewed from the front of the depository) being configured in elevation as shown in FIGS. 4, 12 and 13 and includes a notched relief 62 in its upper wall. The righthand side wall 63 is essentially similar, as shown in FIGS. 1, 2, 3, 4 and 12, but includes an integral lower rearward arm 64 and omits any relief in its upper wall. The exterior top edge of each side wall 61 and 63 is provided with a pair of spaced, integral ears 65 fitted with linear bearings 66 which receive the guide rods 24 and 25 on which the drawer 60 is suspended. At their lower edges the side walls 61 and 63 are connected by a floor plate 67 adjacent which rises a pair of arcuate ribs 68 integral with the inner faces of the side walls 61 and 63 and of the same radius as the drum 30, the inner faces of the side walls 61 and 63 to the rear of the ribs 68 being spaced apart equal to the length of the drum 30. Adjacent the lower ends of the ribs 68 are secured a pair of wear blocks 69 whose rear faces are also concentric with the ribs 68. A stripper bar 70 interconnects the tops of the side walls 61 and 63 and is provided with ribs 71 which intermesh with the ribs 31 on the outer periphery of the drum 30. Intermediate the floor plate 67 and the stripper bar 70 a transverse inclined shelf plate 72 also interconnects the side walls 61 and 63 via brackets 73, the rear transverse edge of the shelf plate 72 also having ribs 74 intermeshing with the ribs 31 of the drum 30. Hence the drawer 60 can slide on the guide rods 24 and 25 between its rear position shown in FIGS. 1, 3 and 6 and its forward position shown in FIGS. 2 and 4.

In order to bias the drawer 60 to its rear position a negator spring 74 is attached between the rear end plate 14 and the drawer side wall 61. A stop collar 75 (see FIG. 6) is attached to the guide rod 24 in order to limit the rear travel of the drawer 60, and to the arm 64 of the side wall 63 is attached a rearwardly extending latch bar 76 having a row of teeth 77 along its upper rear edge. The teeth 77 engage a pawl 78 pivoted at 79 and released by a solenoid 80. Above the latch bar 76 at the rear end of the arm 64 is a latch pin 81 engagable with the latch plate 45 of the drum 30, a cam plate 82 being attached to the inner face of the adjacent square bar 21 in alignment with the latch plate 45 (see FIGS. 1, 2, 5 and 8). On the other side of the depository an upstanding plate 83 is attached to the adjacent square bar 21 along the top of which is a short rack 84 in alignment with the drum spur gear 39 (see FIGS. 3, 4, 6 and 8). To the rear face of the front end plate 15 is attached a sheet metal bracket 85 having an underlying cam profile 86 aligned to intercept the path of the pin 43*b* on the lever block 40 of the drum 30 when the latter reaches its forward position, as shown in FIG. 4.

In order to allow the depository to be operated by a customer with a key (instead of a card) a key retention mechanism is incorporated. This consists of an upright bar 90 secured to the rear face of the plate 83 to the upper end of which is pivoted at 91 the top end of a lever 92 having a flanged front face 93 (see FIGS. 3–8). The lower end of the lever 92 is pivoted at 94 to the rear end of a rod 95 extending forwardly along side the adjacent rail 13 and through the front end plate 15. The rod 95 immediate its ends passes through an inverted U-shaped bracket 96 secured to the square bar 21 above. Between the legs 97 of the bracket 96 a compressible coil spring 98 surrounds the rod 95, being captured between a pair of washers 99, the forward washer 99 being backed by a stop pin 100 (see FIGS. 3, 4 and 6). Finally, the front of the drawer 60 is provided with retainers 101 (see FIGS. 12 and 13) to secure a decorative front (not shown) to the drawer 60 in keeping with the decor of the front face of the ATM. Preferably, the margins of the ATM face surrounding the side and top margins of the drawer front are formed as a separate "pinch-bar" which, should a customer's fingers or the bag deposit itself jam between the front face of the ATM and the drawer 60 as the latter is closing, activates a microswitch to reverse the motor 56 and reopen the drawer 60. Other aspects of the structure and operation of the depository with respect to an ATM will be apparent to those of skill in the art and so need not be further described.

b. Operation

Figure 1:
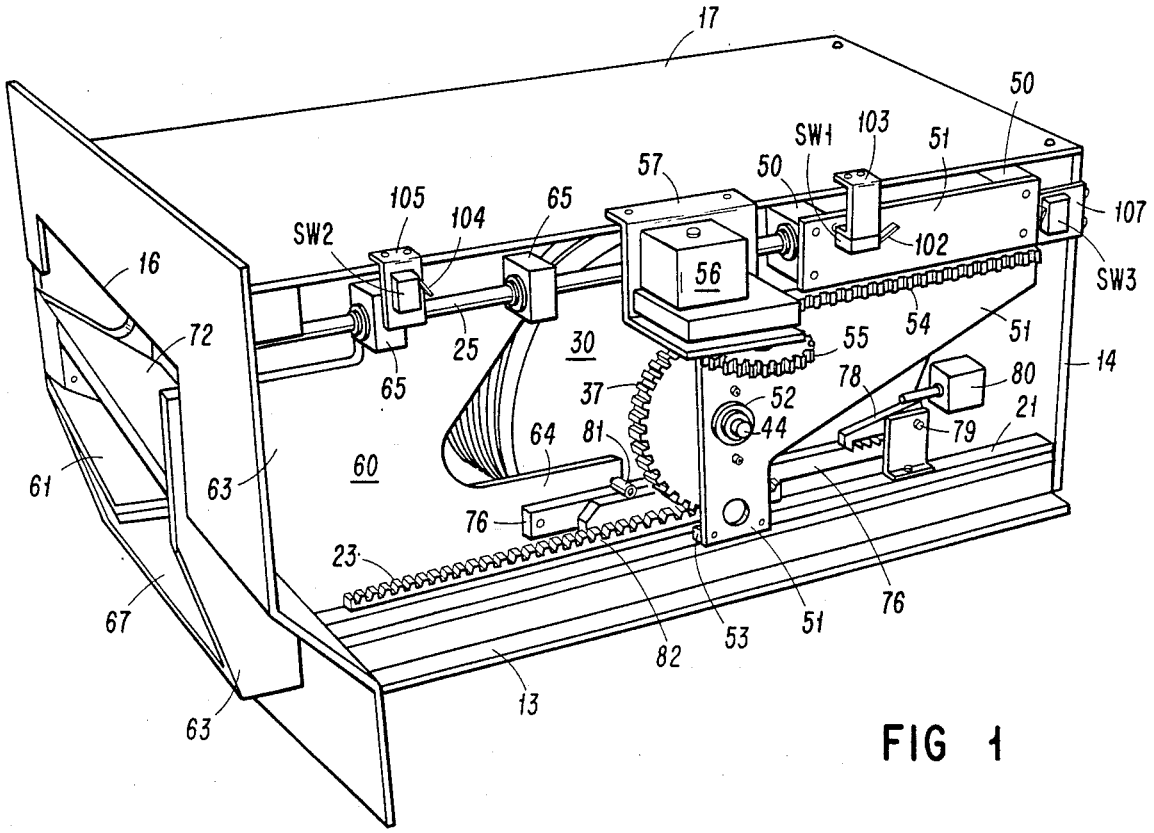
FIG. 1 is a perspective view of one side of the bag depository of the invention showing the depository in its deposit dump or closed position.
Figure 3:
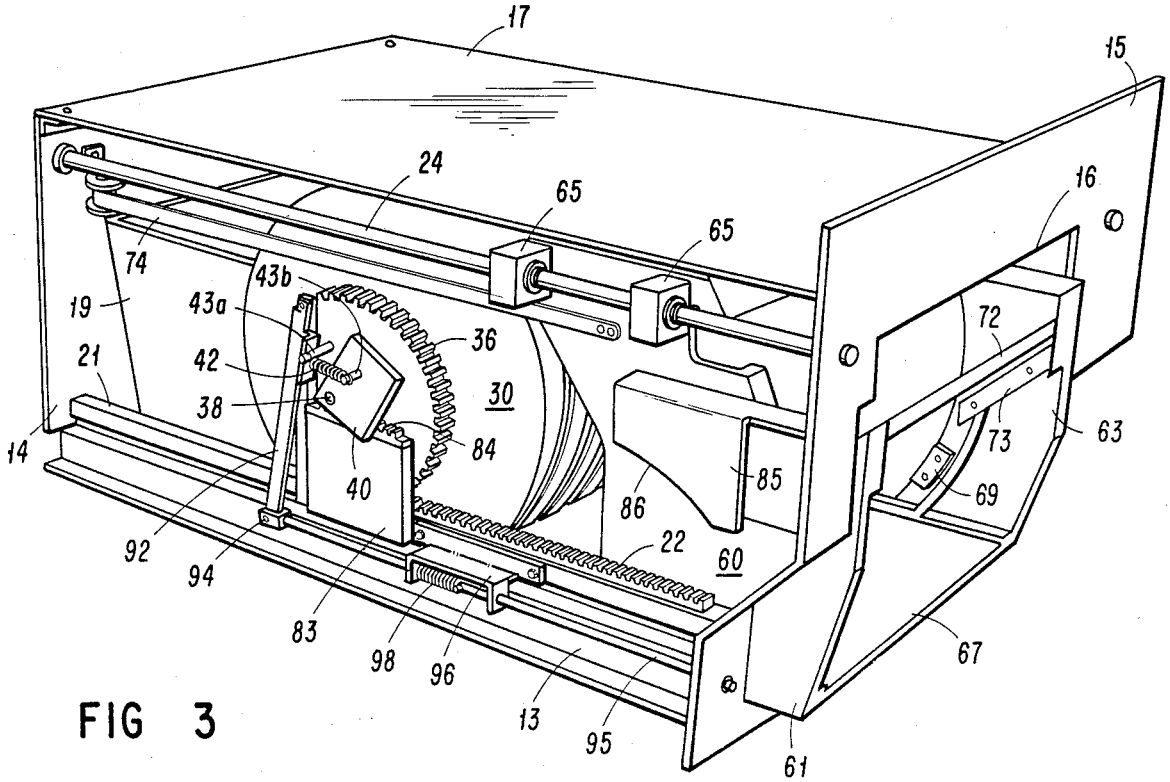
FIG. 3 is like FIG. 1 and illustrates the other side of the depository in its closed position.

Assume first that the depository is in its closed position as shown in FIGS. 1 and 3. A customer drives up to the ATM and inserts his card. After identification as the authorized user of the card the customer signals the ATM that he or she wishes to make a deposit. If the ATM determines that it is an authorized transaction for the customer, the drive motor 56 is energized, whereupon the drum 30, impelled by the rack 54 and pinion gear 55, rotates about its axis and at the same time moves forward on the racks 22 and 23 by virtue of the sector gears 36 and 37 in a direction laterally of the drum axis towards the rear of the drawer 60. Just as the drum 30 reaches an intermediate position, which in a commercial embodiment of the invention is about 7 inches forward of its rear position, and as the periphery of the drum 30 just engages the wear blocks 69 on the inner faces of the drawer side walls 61 and 63, the drum bracket plate 51 above the rack 54 disengages the arm 102 of a microswitch SW1 secured to the cover plate 17 by a bracket 103. Closing of the switch SW1 energizes the solenoid 80 and lifts the pawl 78 to disengage the teeth 77 of the drawer latch bar 76 in order to release the drawer 60. At the same time the breast 45*a* of the drum latch plate 45 has dropped off the ramp 82*a* of the cam plate 82 and engaged the drawer latch pin 81, thus coupling the drawer 60 to the drum 30 so that the former cannot be moved relative to the latter.

Figure 2:
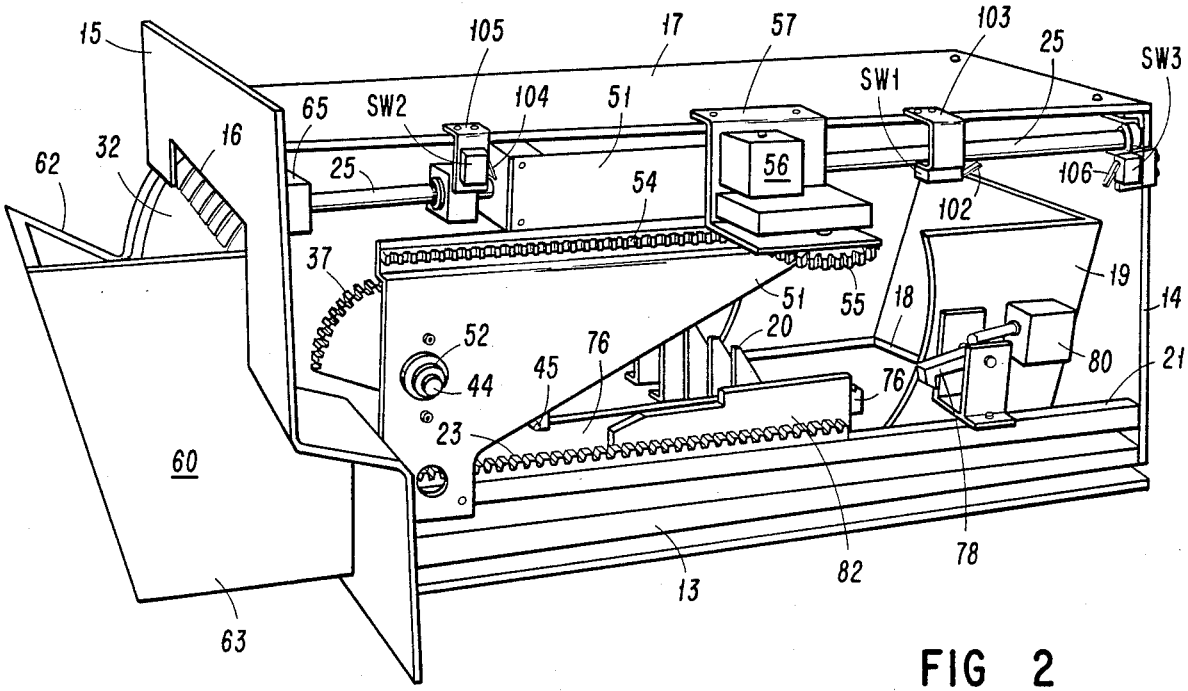
FIG. 2 is similar to FIG. 1 but illustrating the depository in its deposit receiving or open position.

As the drum 30 continues forward it pushes the drawer 60 to its open position shown in FIGS. 2 and 4 which in the commercial embodiment of the invention mentioned is 4½ inches forward of its closed position so that the overall forward travel of the drum 30 is 11½ inches. Note that as the drum 30 and drawer 60 move forward, the pin 43*b* on the lever plate 40 engages the cam profile 86 of the bracket 85 as shown in FIG. 4. This locks the shaft 38 and thus the clearing fingers 41 in the position shown in full lines in FIG. 11 and prevents reaching in the cavity 32 and in some manner rotating the fingers 41 against the spring 42 to the position shown in broken lines in FIG. 11 so that the rear of the depository can be "fished" through the slots 34. When the drum 30 and drawer 60 are in their full forward position the drum cavity 32 then opens upwards, the shelf plate 72 forming a forward extension of the lower cavity wall 32*b* as shown in FIG. 5. At that point the forward linear bearing 50 of the drum 30 contacts the arm 104 of a microswitch SW2 secured to a bracket 105 depending from the cover plate 17 (see FIGS. 2 and 5) deenergizing the motor 56 and the solenoid 80, the latter allowing the pawl 78 to drop down ready to engage the latch bar 76 on return of the drawer 60. The customer then makes his deposit into the drum 30, the notch 62 in the drawer side wall 61 enabling the customer better to see the entire interior of the cavity 32 and the receipt of his deposit into same. The customer than signals the ATM to close the depository. If he or she does not or no deposit is made, the depository "times out" and automatically closes.

In any event, on the customer's signal to the ATM or owing to the "time out", the motor 56 is reenergized in the reverse direction and the drum 30, now traveling in the opposite direction laterally of its axis, together with the drawer 60 retreat, the latter being pulled by the negator spring 74 and the drum 30 owing to the engagement of the latch plate 45 and the latch pin 81 (see FIG. 5). Just before the drum 30 reaches its intermediate position the breast 45*a* of the latch plate 45 engages the ramp 82*a* of the cam plate 82 raising the latch plate 45 and so releasing the drawer 60, which is then in its closed position, from the drum 30. Previously the pawl 78 has reengaged the drawer latch bar 76, preventing the drawer 60 from being reopened both before the latch plate 45 has released the drawer 60 as well as during the remainder of the drum 30's rearward travel. Shortly after the drum 30 has been released from the drawer 60, the spur gear 39 (see FIG. 6) on the other end of the drum 30 engages the rack 84, thus rotating the shaft 38 against the tension of the spring 42 and causing the cavity clearing fingers 41 to sweep the cavity 32 counter clockwise as viewed in FIG. 6. The sweep begins when the cavity wall 32*a* is about 40° below the horizontal, at which point the drum 30 has entered its dumping phase, and continues for an additional 34° or so to remove any object struck in the cavity 32, at which point the fingers are disposed as shown in the broken lines 41 in FIG. 11 and the drum 30 has returned to its rear position shown in FIGS. 1 and 3. In case an envelope or the like should be struck to the cavity wall 32*a* between the latter and the fingers 41, it will be engaged by the cavity clearing plates 20 which sweep the cavity 32 in the opposite direction during the last portion of the dumping phase of the drum 30. If the cavity 32 is not cleared by the plates 20 or the fingers 41, the motor 56 will stall and then the depository will "time out" and shut down until serviced. At the end of the drum 30's rearward travel the linear bearing 50 at the rear end of the drum bracket 51 contacts the switch arm 106 of a microswitch SW3 secured on a bracket 107 fixed to the rear end plate 14 and deenergizes the motor 56. The depository is then ready for a new cycle of operation. Note that when the drum 30 moves forward again the drum spur gear 39 and the rack 84 rotate the clearing fingers 41 in the opposite direction to return them to the position shown in full line in FIG. 11.

If the depository is operated with a key instead of a card, the key operates a lock (not shown) adjacent the forward end of the retension rod 95. At that time the pin 43*a* on the drum sector gear 36 bears against the face 93 of the lever 92, holding the rod 95 in its rear position shown in FIG. 3 against the spring 98 which is compressed between the bracket 96 and the stop pin 100. When the key is turned to unlock the depository it also energizes the motor 56 and as the drawer 30 and pin 43*a* move forward the lever 92 is released and the rod 95 springs forward to the position shown in FIGS. 4 and 5. In that position the rod 95 prevents withdrawal of the key until the depository has completed its cycle and the rod 95 has been withdrawn once again, the motor 56 being deenergized by the switch SW3 in the previous manner.

The bag depository can be employed in an ATM in addition to an envelope depository, such as that shown in the copending application of Fee et al, Ser. No. 031,762, filed Mar. 30, 1987, or the envelope depository can be omitted and the bag depository serve both for envelope as well as bag deposits. The depository can also be used apart from an ATM as a drive-up depository for bags or envelopes or both. Furthermore, the drum alone, without the drawer, can be advantageously employed, for the reasons previously explained, in a walk-up type ATM, or by itself as a typical walk-up type after-hours depository. So though the invention has been described in terms of a particular embodiment, being the best mode known of carrying out the invention, it is not limited to that embodiment alone. Instead the following claims are to be read as encompassing all adaptations and modifications of the invention falling within its spirit and scope.

We claim:

1. In depository apparatus having a generally cylindrical drum including a cavity therewithin with an opening through the periphery of the drum to receive items to be deposited, the drum being rotatable about its axis from an item receiving position in which the drum cavity opens upwardly and an item discharge position in which the drum cavity opens downwardly, and means for rotating the drum as aforesaid, the improvement comprising: means to move the drum in opposite directions laterally of its axis as the drum rotates between its item receiving and its item discharge positions, the drum being in a forward position when the drum cavity is in its item receiving position and in a rear position when the drum cavity is in its item discharge position.

2. The apparatus of claim 1 wherein the drum rotating means also includes the drum moving means.

3. The apparatus of claim 2 wherein the drum rotating and moving means include a pair of drum gears co-axial with the drum and fixed to its outer ends, first and second laterally spaced stationary racks extending in said directions and engaging the drum gears, and means to propel the drum in said directions along the racks.

4. The apparatus of claim 3 wherein the propelling means includes a drive member disposed at an outer end of the drum, the drum being journaled for rotation relative to the drive member, and means for driving the drive member in said directions.

5. The apparatus of claim 4 wherein the driving means include a third rack fixed to the drive member and disposed parallel to the first and second racks, and a stationary reversible electric motor having a pinion gear engaging the third rack.

6. The apparatus of claim 1 including a chassis extending in said directions and having a front wall disposed transversely thereof with an access opening therein, and a closure assembly for said access opening having a forward member interconnecting a pair of side members extending in said directions, the closure assembly being movable in said directions relative to said front wall between a closed position and an open position in which said forward member is disposed forwardly of said front wall; wherein the drum is disposed rearward of the closure forward member and is carried by and moved as aforesaid within the chassis, the drum being moveable relative to the closure assembly when in its closed position as the drum moves in said directions between the drum rear position and an intermediate position between the drum rear and forward positions, the drum when in said intermediate position becoming operatively associated with the closure assembly effective to move the closure assembly from its closed to its open position as the drum moves from said intermediate position to its forward position, the drum cavity having a lower wall inclining upwardly and forwardly to said drum opening when the drum is in its forward position; and wherein the closure forward member includes a shelf forming an upwardly inclined forward extension of said drum cavity lower wall when the drum is in its forward position.

7. The apparatus of claim 6 including first interconnecting means interconnecting the closure assembly and the chassis effective to prevent movement of the closure assembly towards its open position while the drum is at its rear position or between its rear position and said intermediate position, and first disconnecting means for disconnecting the closure assembly from the chassis while the drum moves from said intermediate position to the drum forward position.

8. The apparatus of claim 7 including second interconnecting means operatively interconnecting the drum and the closure assembly effective so that the drum moves the closure assembly from its open to its closed position as the drum moves from its forward position to said intermediate position, and second disconnecting means for disconnecting the closure assembly from the drum as the drum moves from said intermediate position to its rear position.

9. The apparatus of claim 7 wherein the first interconnecting means comprises a latch bar secured to the closure assembly and having a plurality of serrations extending in said directions, and a pawl secured to said framework and engaging the serrations of the latch bar while the closure assembly is in its closed position or moving from its open to its closed position; and wherein the first disconnecting means comprises electromagnetic means effective to release the pawl from the latch bar when the drum reaches said intermediate position during the movement of the drum from its rear to its forward position.

10. The apparatus of claim 8 wherein the second interconnecting means comprises a latch pin secured to the closure assembly and extending transversely of said directions, and a latch plate journaled on the drum about an axis transversely of said direction, the latch plate being engaged with the latch pin during movement of the drum between said intermediate position and the drum forward position; and wherein the second disconnecting means comprises a cam plate having a camming surface extending in said directions effective to disengage the latch plate from the latch pin during travel of the drum between said intermediate position and the drum rear position.

11. The apparatus of claim 6, 7, 8, 9 or 10 wherein the drum rotating means also includes the drum moving means.

12. The apparatus of claim 11 wherein the drum rotating and moving means include a pair of drum gears co-axial with the drum and fixed to its outer ends, first and second laterally spaced stationary racks extending in said directions and engaging the drum gears, and means to propel the drum in said directions along the racks.

13. The apparatus of claim 12 wherein the propelling means includes a drive member disposed at an outer end of the drum, the drum being journaled for rotation relative to the drive member, and means for driving the drive member in said directions.

14. The apparatus of claim 13 wherein the driving means includes a third rack fixed to the drive member and disposed parallel to the first and second racks, and a stationary electric motor having a pinion gear engaging the third rack.

* * * * *